United States Patent [19]

Yoshizawa

[11] 4,175,374

[45] Nov. 27, 1979

[54] TIMEPIECE

[75] Inventor: Keiichi Yoshizawa, Tokyo, Japan

[73] Assignee: Kabushiki Kaisha Seikosha, Japan

[21] Appl. No.: 818,324

[22] Filed: Jul. 22, 1977

[30] Foreign Application Priority Data

Jul. 23, 1976 [JP] Japan ..... 51-87873

[51] Int. Cl.[2] ..... G04B 13/02; G04C 3/00

[52] U.S. Cl. ..... 58/23 R; 58/7; 58/23 D; 58/52 R; 58/53; 58/57; 58/59; 58/88 R

[58] Field of Search ..... 58/7, 23 R, 23 D, 52–55, 58/57, 59, 88 R, 4 A, 7, 38 R, 38 D, 85.5

[56] References Cited

U.S. PATENT DOCUMENTS

| | | | |
|---|---|---|---|
| 3,945,192 | 3/1976 | Wolber | 58/7 |
| 4,087,957 | 5/1978 | Miyasaka et al. | 58/23 D |

*Primary Examiner*—Edith S. Jackmon

*Attorney, Agent, or Firm*—Robert E. Burns; Emmanuel J. Lobato; Bruce L. Adams

[57] ABSTRACT

Timepiece comprises an upper case, a middle plate connected to the upper case, and a lower case connected to the upper case. Gear train and driving mechanism of the timepiece are supported by the upper case and the middle plate. Thus inspection and repair can be done very easily.

8 Claims, 3 Drawing Figures

TIMEPIECE

BACKGROUND OF THE INVENTION

The present invention relates to a timepiece.

In a conventional timepiece, the gear train of the timepiece is supported by three base plates, that is, upper plate, middle plate and lower plate, which are secured to a dial base on front side and are covered by a capsule from rear side. Thus the structure becomes complex. Lately a timepiece is proposed in which all the component parts of the timepiece are set between two base plates which serve as capsules as well. Although the structure is simple, there is a disadvantage that the gears come off when the two base plates are disconnected from each other for repair.

SUMMARY OF THE INVENTION

The present invention intends to eliminate the conventional disadvantge described above.

According to a feature of the present invention there is provided a timepiece comprising an upper case, a middle plate connected to said upper case leaving a predetermined space, a gear train supported between said upper case and said middle plate, a motor block secured to said upper case and middle plate, and a lower case connected to said upper case.

One object of the present invention is to provide a timepiece which is of simple structure.

Another object of the present invention is to provide a timepiece in which gear train is supported by an upper plate and a lower plate and does not come off even if a lower base plate is removed thus facilitating repair and inspection.

BRIEF DESCRIPTION OF THE DRAWINGS

Above objects, other objects and characteristic features of the present invention will become evident and will be more readily understood from the following description and claims taken in conjunction with the accompanying drawings in which.

DESCRIPTION OF A PREFERRED EMBODIMENT

Figure 3:
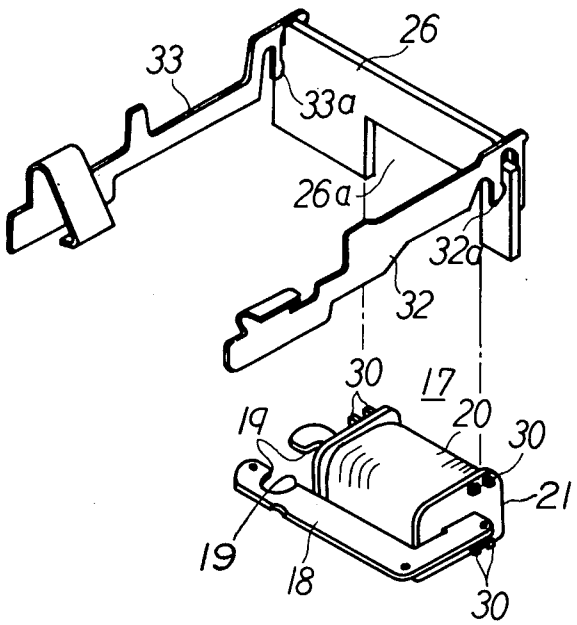
FIG. 3 is an exploded perspective view illustrating a motor block and a circuit block together with contact plates.
Figure 1:
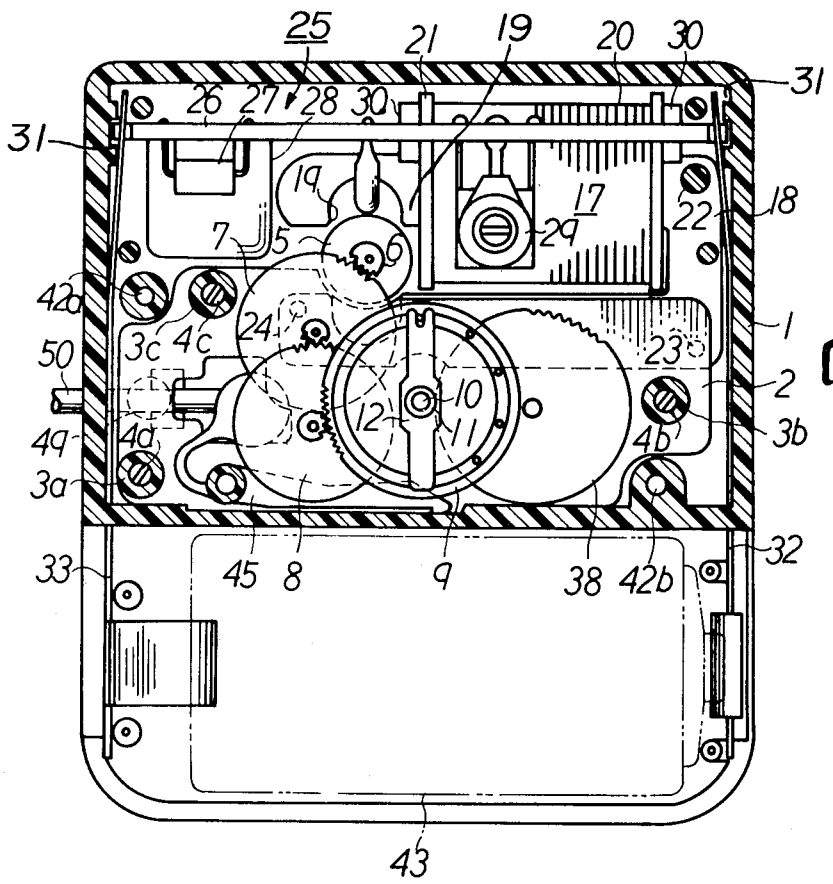
FIG. 1 is a sectional view of a timepiece in accordance with the invention, the upper case being partially broken away.
Figure 2:
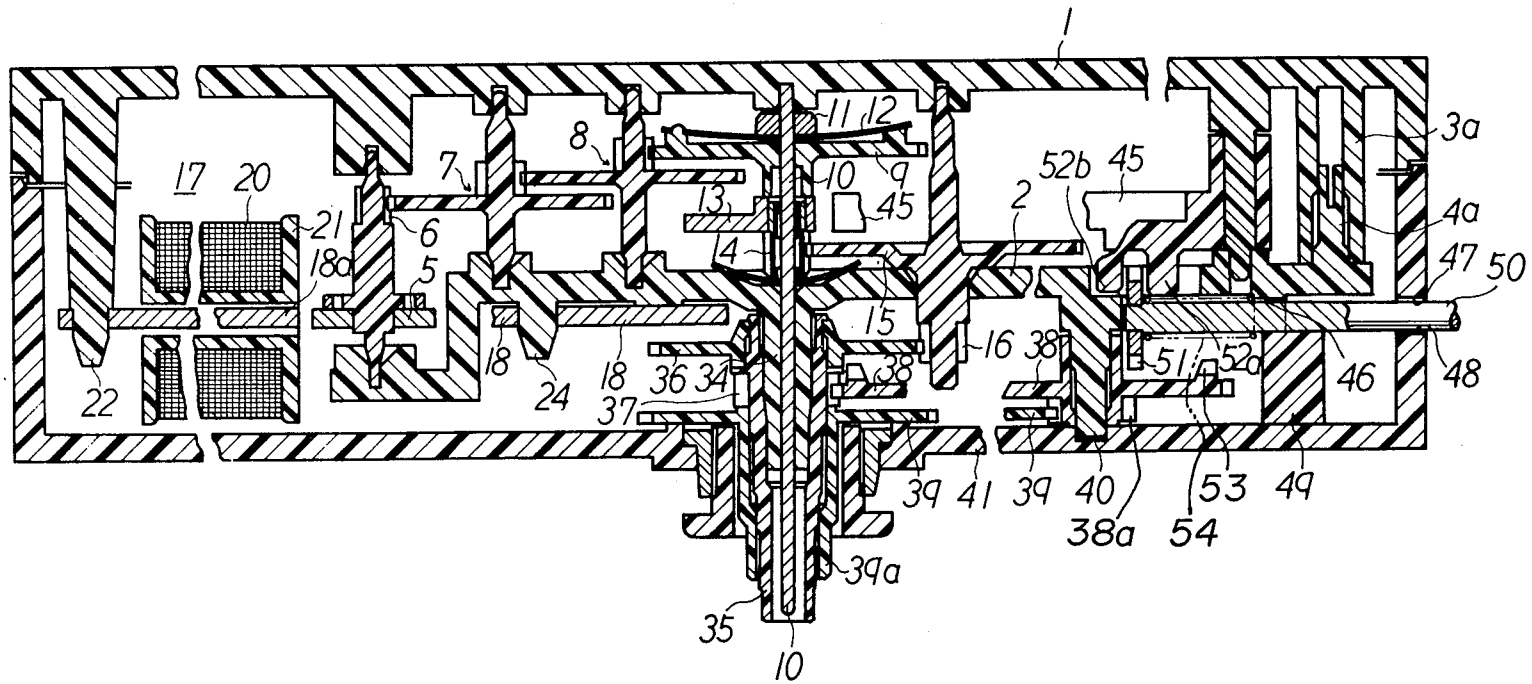
FIG. 2 is an exploded sectional view.

A rear case member shown as an upper case 1 and a middle plate 2 are connected each other with pins 4*a*, 4*b*, 4*c* projecting from the middle plate forced into corresponding pipes 3*a*, 3*b*, 3*c* projecting from the upper case. A rotor 5 secured to a rotor pinion 6, 2nd wheel 7 and 3rd wheel 8 are engaged in order and rotatably supported by the upper case 1 and middle plate 2 therebetween. A second hand wheel 9 in mesh with the 3rd wheel 8 is rotatably supported by a second hand arbor 10 which is further rotatably supported by the upper case 1 and the middle plate 2. A washer 11 is secured to the second hand arbor 10. A lever spring 12 is connected to the washer 11, and pushes the second hand wheel 9 downwards in FIG. 2. A heart cam 13 for resetting second hand and a second hand pinion 14 are secured to the second hand arbor 10. The second hand wheel 9 is pushed downwards by the lever spring 12 to abut against the heart cam 13. Therefore the rotation of the second hand wheel 9 is transmitted to the second hand arbor 10, but the rotation of the second hand arbor 10 is not transmitted to the second hand wheel 9. An intermediate wheel 15 engaging with the second hand pinion 14 is supported by the upper case 1 and the middle plate 2 and provided integrally with an intermediate pinion 16 projecting downwards from the middle plate 2. Thus the gear train of the timepiece from the rotor 5 to the intermediate pinion 16 is as a whole supported between the upper case 1 and the middle plate 2.

A motor block 17 is supported by the upper case 1 and the middle plate 2. A bobbin 21 wound by a coil 20 is supported by a stator 18 at its one stator arm 18*a*. At the center of four magnetic poles 19 of the stator 18, the rotor 5 is located. The stator 18 is provided with three holes into which a pin 22 projecting from the upper case 1 and pins 23, 24 projecting from the middle plate are respectively forced.

A circuit block 25 is secured to the motor block 17. A printed circuit board 26 carries IC 27, a quartz oscillator 28, trimmer 29 and other circuit elements. The circuit board 26 is provided with a cutout portion 26*a* into which the bobbin 21 is set. Four pairs of projections 30—are provided on side plates of the bobbin 21 and each pair of the projections hold the circuit board 26 therebetween. Both ends of the coil 20 are respectively connected to the predetermined positions of the printed circuit on the board 26. Contact plates 32 and 33 for a battery 43 are secured to both end portions of the circuit board 26 with their forked potions 32*a* and 33*a* catching the board. The both ends of the circuit board 26 are inserted between guides 31 and 31 projecting from the upper case 1.

Transmission gear train to a minute hand and an hour hand is hereafter explained. The second hand arbor 10 penetrates through a bearing 34 projecting downwards from the middle plate 2. A minute hand pipe 35 is rotatably supported about the bearing 34. A minute hand wheel 36 is frictionally supported about the minute hand pipe 35 and engages with the intermediate pinion 16. A minute hand pinion 37 integral with the minute hand pipe 35 engages with a transmission wheel 38 rotatable about an arbor 40 projecting from the middle plate 2. And a pinion 38*a* on the transmission wheel 38 engages with an hour hand wheel 39 integrally provided with an hour hand pipe 39*a*.

The upper case 1 and the middle plate 2 are made of synthetic resin such as polycarbonate which is low in dimensional change and can be molded precisely. A front case member shown as a lower case 41 is made of synthetic resin such as ABS (acrylonitrile-butadiene-styrene copolymer) which is elastic and hardly broken by stress. The upper case 1 is provided with two screw holes 42*a* and 42*b* and the lower case 41 is provided with two pins not shown facing the screw holes and formed with interior screw holes. Thus the upper case 1 and the lower case 41 are connected each other by screws.

Means for correcting the hands is hereafter explained.

A correct lever 45 for pushing the heart cam 13 is rotatably supported between the upper case 1 and the middle plate 2. A correct shaft 50 is supported by a guide portion 46 provided in the middle plate and a guide pin 49 projecting upwards from the lower case 41 facing to the guide portion. The correct shaft 50 extends through and is also supported by a cutout portion 47 in the upper case 1 and a cutout portion 48 in the lower case 41. A correct pinion 51 is secured to the end portion of the correct shaft 50. The correct pinion 51 is located between pins 52*a* and 52*b* projected from the correct lever 45. The transmission wheel 38 is provided with a crown gear 53, which is engageable with the correct pinion 51. A coil spring 54 is provided around the correct shaft 50 between the correct pinion 51 and the guide portion 46. When the correct shaft 50 is pulled leftwards in FIG. 2 against the push of the coil spring 54, the correct pinion 51 actuates the correct lever 45 and the heart cam 13 is turned to a predetermined position to reset the second hand, that is, to direct the second hand to zero. In order to correct the minute hand and the hour hand, the correct shaft 50 is turned under the pulled state. The correct pinion 51 engaged with the crowngear 53 rotates the transmission wheel 38 and accordingly the minute hand pinion 37 is rotated.

When the timepiece is to be assembled, the gear train from the rotor 5 to the intermediate wheel 15 and the correct lever 45 are set between the upper plate 1 and the middle plate 2. The motor block 17 and the circuit block 25 are connected each other, and the contact plates 32 and 33 are secured to the circuit board 26. Then the both ends of the board 26 are inserted into the guides 31, 31 and, concurrently the pins 22, 23 and 24 are inserted into the holes provided in the stator 18. Thus the motor block 17 and the circuit block 25 carrying the contact plates 32 and 33 are secured to the upper plate 1 and the middle plate 2.

Under this state, inspection and adjustment are performed. Then the correct shaft 50 and the gear train from the minute hand wheel 36 to the hour hand wheel 39 are set and the lower case 41 is connected to the upper case 1 to complete assemblage.

When repair is required, the lower case 41 is disconnected and a battery is set between the contact plates 32 and 33. The driving mechanism is inspected under the driving state.

What is claimed is:

1. A timepiece comprising:

an upper case;

a middle plate connected to said upper case with a predetermined space therebetween;

a lower case removably connected with said upper case and spaced from said middle plate;

hands for indicating time;

a movement comprising a motor block and a circuit block for actuating said hands, secured to and supported by said upper case and said middle plate;

and means comprising a gear train for transmitting rotation from said motor block to said hands, said gear train being supported between said upper case and said middle plate independently of said lower case;

whereby said movement is operable with said lower case removed.

2. A timepiece according to claim 1, in which said upper case and middle plate are composed of synthetic resin having low dimensional change and said lower case is composed of synthetic resin which is elastic and break resistant.

3. A timepiece according to claim 1, in which said movement comprises a minute hand pipe and hour hand pipe connecting said gear train with said hands, said pipes extending through said lower case.

4. A timepiece comprising:

a front case member, a rear case member removably connected with said front case member, a middle plate mounted on said rear case member, said middle plate being disposed between and spaced from said front case member and said rear case member;

a motor comprising a motor block and circuit block secured to said rear case member and said middle plate;

a gear train driven by said motor and supported by said rear case member and said middle plate and comprising gears disposed between said rear case member and said middle plate;

an hour hand pipe and minute hand pipe driven by said gear trains and extending through said front case member; and an hour hand and minute hand mounted respectively on said hour hand pipe and minute hand pipe;

said motor and gear train being supported independently of said front case member and being operable with said front case member removed.

5. A timpiece according to claim 4, in which said gear train includes an intermediate wheel disposed between said rear case member and said middle plate and having a shaft portion extending through a bearing hole in said middle plate, an intermediate pinion integral with said shaft portion and disposed between said middle plate and said front case member and a minute hand wheel on said minute hand pipe and driven by said intermediate pinion.

6. A timepiece according to claim 5, in which said middle plate has an arbor projecting toward said front case member, and in which said gear train includes a minute hand pinion on said minute hand pipe, a transmission wheel rotatable on said arbor and driven by said minute hand pinion, a transmission pinion integral with said transmission gear, and an hour wheel on said hour hand pipe and driven by said transmission pinion.

7. A timepiece according to claim 6, comprising a crown gear on said transmission wheel, a correction shaft rotatably and slidably supported on said middle plate and a correction pinion on said correction shaft engageable with said crown gear when said correction shaft is slid axially to a predetermined position.

8. A timepiece according to claim 7, comprising a second hand arbor extending through said middle plate and rotatably supported by said rear case member and middle plate a heart cam fixed on said second hand arbor between said rear case member and middle plate and a correction lever rotatably supported between said rear case member and middle plate and engageable with said heart cam, and means connecting said correction lever with said correction shaft for movement into engagement with said heart cam when said correction shaft is moved to engage said correction pinion with said crown gear.

* * * * *